United States Patent [19]

Jackel et al.

[11] Patent Number: 4,895,480

[45] Date of Patent: Jan. 23, 1990

[54] METHOD AND APPARATUS FOR FORMATION OF A TUNNEL LINING

[75] Inventors: Gert Jackel, Bottrop; Karl Kohler, Rees-Esserden; Friedrich Schoter, Oberhausen, all of Fed. Rep. of Germany

[73] Assignee: Signode Corporation, Glenview, Ill.

[21] Appl. No.: 242,400

[22] Filed: Sep. 9, 1988

[30] Foreign Application Priority Data

Sep. 11, 1987 [DE] Fed. Rep. of Germany ..... 3730574

[51] Int. Cl.[4] ..... E21D 9/06; E21D 11/00

[52] U.S. Cl. ..... 405/147; 405/146; 405/150

[58] Field of Search ..... 405/146, 150, 147, 152, 405/289

[56] References Cited

U.S. PATENT DOCUMENTS 3,788,087 1/1974 Patin ..... 405/150 X
3,827,244 8/1974 Walbröhl ..... 405/141
4,299,748 11/1981 Hashizume et al. ..... 525/212 X
4,302,558 11/1981 Ohya et al. ..... 525/212 X
4,466,758 8/1984 Hinterreiter et al. ..... 405/150

*Primary Examiner*—Dennis L. Taylor
*Assistant Examiner*—Arlen L. Olsen
*Attorney, Agent, or Firm*—Schwartz & Weinrieb

[57] ABSTRACT

A method and apparatus for closing or sealing the gap space defined between a tunnel support frame and the ground during the tunneling formation of adits in connection with underground mining operations and the construction of underground tunnels, wherein backfill concrete is introduced into the gap space, comprises the disposition of inflatable bags within the gap space so as to be in abutment with the backfill concrete. In this manner, proper and complete backfilling is able to be achieved whereby the cured backfill concrete will exhibit proper structural integrity. The bags may be fabricated from a suitable plastic foil and are provided with an inflating-deflating valve. The bags can be reused upon subsequent support frame sections as the tunneling operation progresses.

32 Claims, 2 Drawing Sheets

METHOD AND APPARATUS FOR FORMATION OF A TUNNEL LINING

FIELD OF THE INVENTION

The present invention relates generally to the formation of tunnel structures, and more particularly to a method and apparatus for closing or filling the gap space defined between the last tunnel support frame, of a serial array of tunnel support frames, and the ground during the tunneling or formation of adits in connection with underground mining operations or alternatively during the formation or construction of tunnel structures wherein the tunnel support frames are usually provided with lagging mats disposed thereon or thereabout, and backfill concrete is introduced into the space defined between the tunnel support frames, with its lagging mats disposed thereon or thereabout, and the ground.

BACKGROUND OF THE INVENTION

The complete and safe closure or filling of the gap space defined between the ground and the tunnel support frames employed during the formation of mining tunnels, underground rooms, roadway tunnels, and the like, is of utmost importance since a complete and proper backfilling of the space defined between the tunnel support frames, with its lagging mats disposed thereon or thereabout, and the ground with backfilling concrete material is not otherwise assured. Insufficient backfilling can of course jeopardize mine safety, in the instance of mine tunnel construction, or the safety of members of the public, other than miners normally employed within mines, which may be using, or within the vicinity of, the other structures which may be constructed due to potentially dangerous cave-in conditions. This is especially true in the instance of construction of tunnels or similar underground structures within ground locations exhibiting low load-bearing capacity.

In order to close the gap space defined between the last tunnel support frame and the ground, it is conventionally known to dispose an end casing within the vicinity of the last tunnel support frame and to connect it, on the ground side, to the last tunnel support frame. However, this operation is expensive, and is additionally difficult to construct or achieve such that a complete and proper backfill will in fact be assured or achieved.

Another type of conventionally known or employed system for closing the gap space defined between the last tunnel support frame and the ground involves the placement of a large-caliber hose upon the tunnel support frame, and the filling of the hose, at a substantially high pressure value, with the backfill concrete. The introduction or employment of the relatively long hose, however, is operationally difficult to achieve, and in addition, auxiliary means must be employed in connection with the hose in order to insure the fact that the hose will remain fixed at its specified location or position while the backfill concrete is being introduced thereinto. Still further, multiple usage of the hose is not possible.

OBJECTS OF THE INVENTION

Accordingly, it is an object of the present invention to provide a new and improved method and apparatus for closing or filling the gap space defined between the tunnel support frames and the ground such that a complete and proper backfilling of the gap space can in fact be achieved.

Another object of the present invention is to provide a new and improved method and apparatus for closing or filling the gap space defined between the tunnel support frames and the ground which is relatively simple to perform and use.

Still another object of the present invention is to provide a new and improved method and apparatus for closing or filling the gap space defined between the tunnel support frames and the ground which will insure the safety and integrity of the tunnel structure constructed.

SUMMARY OF THE INVENTION

The foregoing and other objectives are achieved in accordance with the present invention wherein expansible bags, which may be fabricated from a suitable plastic foil material, are disposed upon and about the last tunnel support frame so as to be disposed within the gap space defined between the last tunnel support frame and the ground. The bags are constructed so as to be air-tight, and they are provided with at least one inflating-deflating valve. In this manner, the bags can be inflated, by means of compressed air, so as to inflate the same and thereby close or seal the gap space defined between the tunnel support frame and the ground. The inflated or expanded bags also act upon the backfill concrete so as to compress or compact the same in order to achieve a predetermined density level whereby the proper or sufficient amount of backfilling is attained. This, in turn, assures the structural integrity of the formed tunnel structure. The inflatable bags do not require an excessively high degree of pressure in order to achieve the predeterminedly desired closure of the gap space defined between the tunnel support frame and the ground, and in particular, it has been found that good, proper, and safe results can be achieved by means of an inflation pressure of less than 1 bar, and preferably within the range of 0.2–0.5 bar.

The particular arrangement of the inflatable bags upon the tunnel support frames can comprise any one of a plurality of formats, however, in order to insure the safe, complete, and proper backfilling of the concrete within the gap space defined between the tunnel support frames and the ground, the bags are preferably disposed in butt contact with each other, or alternatively, disposed in an overlapping array. It is noted that in accordance with the present inventive method, it is not mandatory to first place all of the inflatable bags in a successively or serially connected or overlapped manner upon the tunnel support frames and to thereafter inflate the same individually with the compressed air, but alternatively, the bags may be individually inflated with compressed air as they are being placed upon the tunnel support frames, or immediately following their individual placement thereon, and in this manner, the operation of installing the bags upon the tunnel support frames is greatly facilitated and simplified. In addition, it is to be further noted that in accordance with the teachings of the present invention, the bags are capable of being deflated upon completion of the concrete backfilling operation, and the curing the backfill concrete within the gap space defined between the tunnel support frames and the ground, whereby the bags can be subsequently re-used upon successive tunnel support frames as the tunnel operation progresses.

BRIEF DESCRIPTION OF THE DRAWINGS

Various other objects, features, and attendant advantages of the present invention will be better understood from the following detailed description of the present invention, when considered in connection with the accompanying drawings, in which like reference characters designate like or corresponding parts throughout the several views, and wherein.

DETAILED DESCRIPTION OF THE PREFERRED EMBODIMENT

Figure 1:
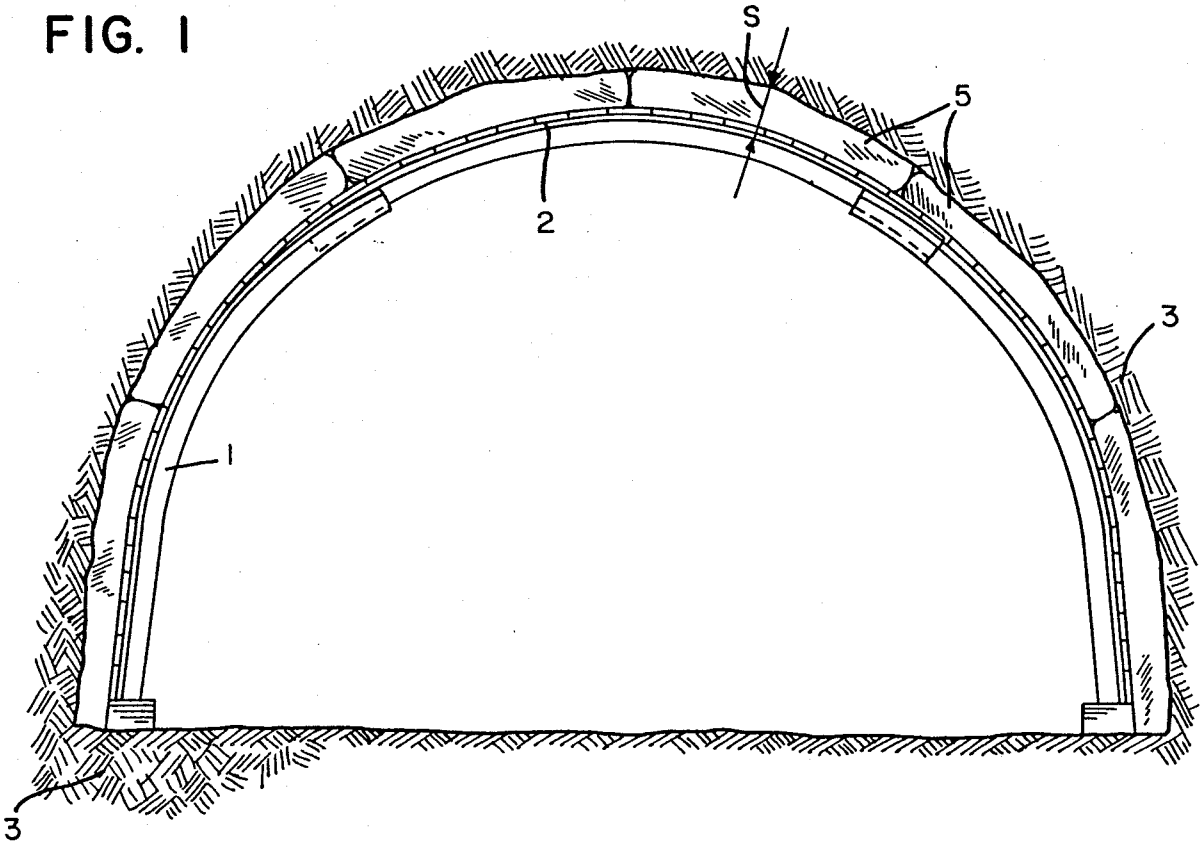
FIG. 1 is a schematic side elevational view of a tunnel support frame being utilized within a tunneling operation in connection with the formation of an underground mine adit, and wherein the closure of the gap space, defined between the tunnel support frame and the ground, is achieved in accordance with the present invention method and apparatus.

Referring now to the drawings, and more particularly to FIG. 1 thereof, there is illustrated a tunnel support frame 1 which is of the type employed within a system of tunnel support frames which are utilized in the construction of tunnels attendant an underground mining operation. In effect, the tunnel support frame 1, for the purposes of the present invention, will be considered to be the last tunnel support frame, within a series of tunnel support frames, in connection with which the present invention is successively or serially practiced as the tunneling operation progresses. The support frame 1, as well as the preceding support frames, is provided with, or covered by, a series of lagging mats 2, and the back fill concrete 4 is disposed within the gap space S defined between the support frames 1, and more particular the lagging mats 2 thereof, and the ground 3, as may also be appreciated from FIG. 2. It is noted that the lagging mats 2 may be covered with a suitable plastic foil or wire mesh, not shown, which of course does not form a part of the present invention and will therefore not be discussed any further herein.

Figure 2:
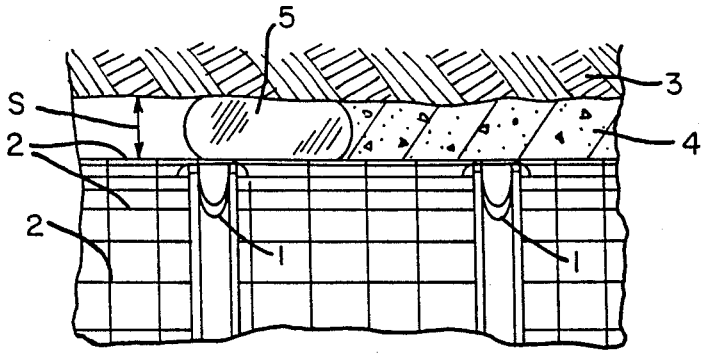
FIG. 2 is a vertical, axial cross-sectional view of the tunnel support frame of FIG. 1 and the ground associated therewith.
Figure 3:
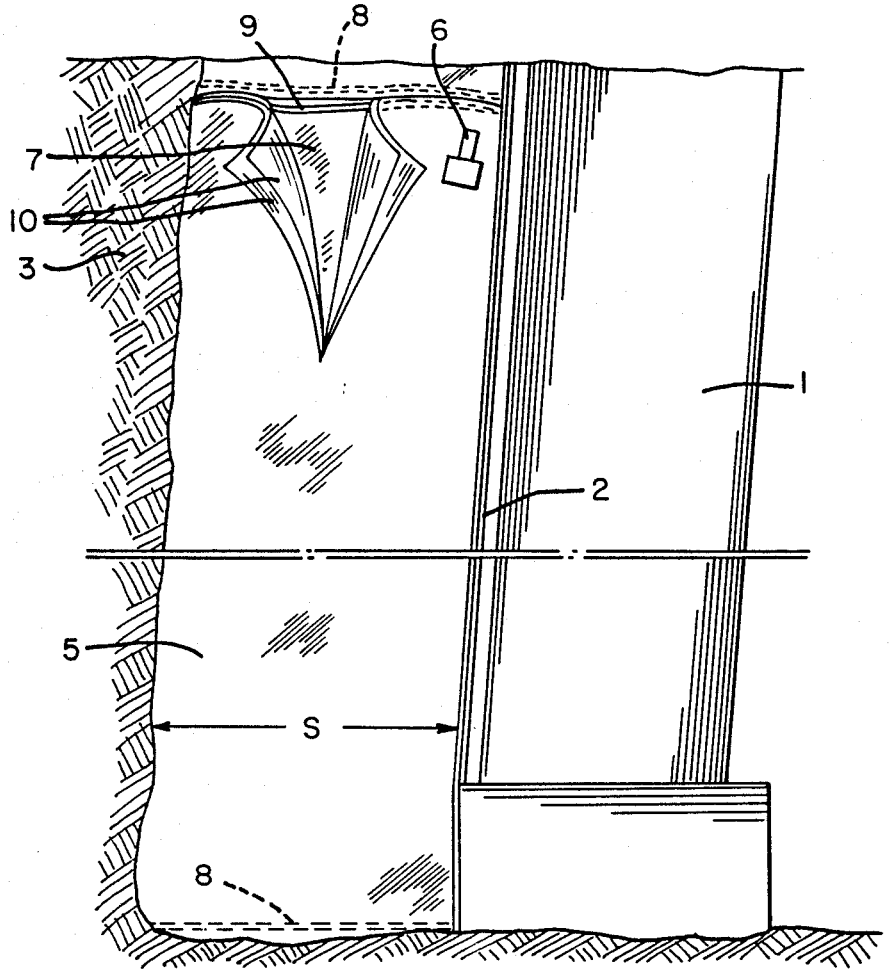
FIG. 3 is a side elevational view of a tunnel support frame having the inflatable mats of the present invention being installed thereon.

Continuing further, and as can be seen from both FIGS. 1 and 2, in accordance with the specific teachings of the present invention, a plurality of serially disposed bags 5, which may be fabricated from a suitable plastic foil material, are disposed upon the last tunnel support frame 1 and within the gap space S defined between the tunnel support frame 1 and the ground 3 so as to, in effect, be in abutment with the backfill concrete 4 which is also disposed within the gap space S defined between the support frames 1 and the ground 3. Each one of the bags 5 is airtight, and as best seen in FIG. 3, is provided with at least one inflating-deflating valve 6. The gap space S is thus closed and sealed by means of the inflatable bags 5 when the latter are in fact inflated with compressed air such that that portion of the gap space S previously surrounding the preceding tunnel support frames 1 and within which the backfill concrete 4 is disposed can in fact be properly, completely, and assuredly filled with the backfill concrete 4 to the desired level or degree which is required to attain or achieve the tunnel structure having the requisite structural integrity upon curing of the backfill concrete 4.

The bags 5 may be inflated with compressed air to a pressure level of approximately 1 bar or less, and preferably to a pressure level of 0.2–0.5 bar. In the illustrated embodiment, the bags 5 are shown as being disposed in butt contact relationships, however, the bags may also be disposed in an overlapping relationship, not illustrated. The individual bags 5 are adapted to be disposed upon the support frames 1 in an individual manner, and inflation of the bags 5 may be achieved individually as they are disposed upon the support frames 1. Subsequent to the introduction of the backfill concrete 4 into the gap space S defined between the support frames 1 and the ground 3, and the curing of the backfill concrete 4, the bags 5 can be deflated such that the same can be moved in the axial direction along successively placed support frames 1 whereby the bags 5 can be re-used as the tunneling operation progresses.

Referring now to FIG. 3, there is shown in more detail the construction or structural components of each inflatable bag 5, and it is seen that each bag 5 comprises an inner plastic hose or tubular portion 7 having a bottom seam 8 and a head seam 9, inflating-deflating valve 6, for admission or evacuation of the compressed air, being in fluidic communication therewith. As is also illustrated, a two-layered protective cover 10 is disposed over hose portion 7, cover 10 likewise being fabricated from a suitable plastic foil or paper material. It is apparent that only valve 6 protrudes out of or exteriorly of cover 10 in order to in fact be connected to a supply of compressed air, not shown. The material from which cover 10 is fabricated may have antistatic properties, and the inflating-deflating valve 6 may comprise a suitable check valve structure, which may be of the spring-loaded type.

Obviously, many modifications and variations of the present invention are possible in light of the above teachings. It is therefore to be understood that within the scope of the appended claims, the present invention may be practiced otherwise than as specifically described herein.

We claim:

1. A method for sealing a gap space defined between a tunnel support frame and the ground during the formation of a tunnel, comprising the steps of:

introducing backfill concrete into said gap space defined between said tunnel support frame and said ground so as to form a portion of said tunnel;

introducing inflatable bag means into said gap space defined between said tunnel support frame and said ground at an axial position along said tunnel which is adjacent to said backfill concrete such that said inflatable bag means is disposed in contact with said backfill concrete; and inflating said inflatable bag means to a predetermined pressure value such that said gap space defined between said tunnel support frame and said ground is sealing closed and said inflatable bag means exerts axial pressure upon said backfill concrete disposed adjacent to said inflatable bag means such that proper and complete backfilling of said gap space defined between said tunnel support frame and said ground, and within which said backfill concrete is disposed, is able to be achieved.

2. A method as set forth in claim 1, wherein:

said inflatable bag means comprises a plurality of bags which are placed about said tunnel support frame.

3. Method according to claim 2, characterized in that the bags are overlapped.

4. Method according to claim 3, characterized in that the bags are successively placed on the tunnel support frame and the individual bags are inflated with compressed air during their placement on the tunnel support frame or immediately thereafter.

5. Method according to claim 4, characterized in that the bags are deflated after introduction and curing of the backfill concrete in the space between the tunnel support frame and the ground, and that the bags are reused on another tunnel support frame in keeping with the tunneling advance.

6. Method according to claim 2, characterized in that the bags are successively placed on the tunnel support frame and the individual bags are inflated with compressed air during their placement on the tunnel support frame or immediately thereafter.

7. Method according to claim 2, characterized in that the bags are deflated after introduction and curing of the backfill concrete in the space between the tunnel support frame and the ground, and that the bags are reused on another tunnel support frame in keeping with the tunneling advance.

8. Method according to claim 6, characterized in that the bags are deflated after introduction and curing of the backfill concrete in the space between the tunnel support frame and the ground, and that the bags are reused on another tunnel support frame in keeping with the tunneling advance.

9. Method according to claim 1, characterized in that the inflatable bag means comprises a plurality of bags which are charged with compressed air at a pressure of less than 1 bar, preferably 0.2 to 0.5 bar.

10. Apparatus as set forth in claim 9, wherein said inflatable bag means comprises a plastic hose with bottom seam and head seam as well as inflating and deflating valve for compressed air.

11. Device according to claim 10, characterized in that the plastic hose, including bottom seam and head seam, is enveloped by a single-layer or multi-layer protective cover consisting of plastic foil and/or paper and that only the valve protrudes out of the protective cover.

12. Device according to claim 11, characterized in that at least the protective cover is antistatically equipped.

13. Device according to claim 11, characterized in that the protective cover comprises a hose that is disposed over said plastic hose.

14. Method according to claim 9, characterized in that the bags are overlapped.

15. Method according to claim 9, characterized in that the bags are deflated after introduction and curing of the backfill concrete in the space between the tunnel support frame and the ground, and that the bags are reused on another tunnel support frame in keeping with the tunneling advance.

16. Apparatus for sealing a gap space within which a tunnel wall structure is to be formed, comprising:

a tunnel support frame spaced radially inwardly from surrounding ground portions so as to define therewith a gap space between said ground portions and said tunnel support frame;

backfill concrete disposed within a first axial portion of said gap space, between said ground portions and said tunnel support frame, for defining a first portion of said tunnel wall when said backfill concrete is cured; and inflatable bag means disposed within a second axial portion of said gap space, between said ground portions and said tunnel support frame, immediately adjacent to said backfill concrete disposed within said first axial portion of said gap space for sealingly closing said gap space and for expansion into said first axial portion of said gap space so as to exert axial pressure upon said backfill concrete disposed adjacent to said inflatable bag means so as to insure proper and complete backfilling of said first axial portion of said gap space by said backfill concrete disposed within said first axial portion of said gap space during the formation of said first portion of said tunnel wall.

17. Apparatus as set forth in claim 16, wherein:

said inflatable bag means comprises a plurality of bags disposed about said tunnel support frame.

18. Apparatus as set forth in claim 17, wherein:

said inflatable bags are disposed in an overlapped relationship with respect to each other.

19. Apparatus as set forth in claim 18, wherein each of said bags comprises a plastic hose with bottom seam and head seam as well as inflating and deflating valve for compressed air.

20. Device according to claim 19, characterized in that the plastic hose, including bottom seam and head seam, is enveloped by a single-layer or multi-layer protective cover consisting of plastic foil and/or paper and that only the valve protrudes out of the protective cover.

21. Device according to claim 20, characterized in that at least the protective cover is antistatically equipped.

22. Device according to claim 20, characterized in that the protective cover comprises a hose that is disposed over plastic hose.

23. Apparatus as set forth in claim 17, wherein:

each of said bags is fabricated from a plastic foil material.

24. Apparatus as set forth in claim 17, wherein:

said inflatable bags are disposed in butt contact with each other.

25. Apparatus as set forth in claim 16, wherein said inflatable bag means comprises a plastic hose with bottom seam and head seam as well as inflating and deflating valve for compressed air.

26. Device according to claim 25, characterized in that the plastic hose, including bottom seam and head seam, is enveloped by a single-layer or multi-layer protective cover consisting of plastic foil and/or paper and that only the valve protrudes out of the protective cover.

27. Device according to claim 26, characterized in that at least the protective cover is antistatically equipped.

28. Device according to claim 27, characterized in that the protective cover comprises a hose that is disposed over plastic hose.

29. Device according to claim 27, characterized in that the inflating and deflating valve is designed as a spring-loaded valve.

30. Device according to claim 26, characterized in that the inflating and deflating valve is designed as a spring-loaded valve.

31. Device according to claim 26, characterized in that the protective cover comprises a hose that is disposed over said plastic hose.

32. Device according to claim 25, characterized in that the inflating and deflating valve is designed as a spring-loaded valve.

* * * * *